United States Patent [19]

Gilpatrick

[11] 3,977,055

[45] Aug. 31, 1976

[54] PILE FABRIC LOOP CUTTING APPARATUS

[75] Inventor: Michael William Gilpatrick, Chesnee, S.C.

[73] Assignee: Deering Milliken Research Corporation, Spartanburg, S.C.

[22] Filed: Jan. 20, 1975

[21] Appl. No.: 542,111

[52] U.S. Cl. ..... 26/9; 30/287; 30/304; 83/168; 83/425; 83/431; 83/678

[51] Int. Cl.[2] ..... D06C 13/08

[58] Field of Search ..... 26/8 R, 8 C, 9, 10 R, 26/10 C, 11, 12; 30/200, 287, 304; 83/168, 425, 431, 592, 663, 664, 678, 835, 838, 848; 112/79 R; 139/291 C

[56] References Cited

UNITED STATES PATENTS

| | | | |
|---|---|---|---|
| 882,313 | 3/1908 | Von Hofe | 26/8 R |
| 1,335,450 | 3/1920 | Mittelholzer | 26/11 |
| 1,757,536 | 5/1930 | Mason | 139/291 C UX |
| 1,860,528 | 5/1932 | Buesser | 26/12 X |
| 1,870,774 | 8/1932 | Gaines | 83/168 |
| 1,956,453 | 4/1934 | Moench | 112/79 R |
| 2,444,079 | 6/1948 | Weber, Sr. et al. | 26/12 |
| 3,344,520 | 10/1967 | Williams | 30/200 |

FOREIGN PATENTS OR APPLICATIONS

| | | | |
|---|---|---|---|
| 64,691 | 4/1913 | Switzerland | 26/12 |

*Primary Examiner*—Robert R. Mackey
*Attorney, Agent, or Firm*—Earle R. Marden

[57] ABSTRACT

Apparatus to cut or shear loop pile fabric by moving the loop pile fabric to be cut or sheared over a rotating cutting member which cuts the loops in the fabric but prevents the fabric backing material from being cut by the use of guard members for the cutting blades.

6 Claims, 4 Drawing Figures

PILE FABRIC LOOP CUTTING APPARATUS

Prior to this invention loop pile fabrics were normally sheared by cutting off the top of each loop to achieve a cut loop or velour effect which resulted in the loss of a considerable amount of yarn which could not be reprocessed for other uses.

Therefore, it is an object of the invention to provide an apparatus to efficiently shear a loop pile fabric which does not result in an excess yarn loss.

Other objects of the invention will become readily apparent as the specification proceeds to describe the invention with reference to the accompanying drawings, in which.

Figure 1:
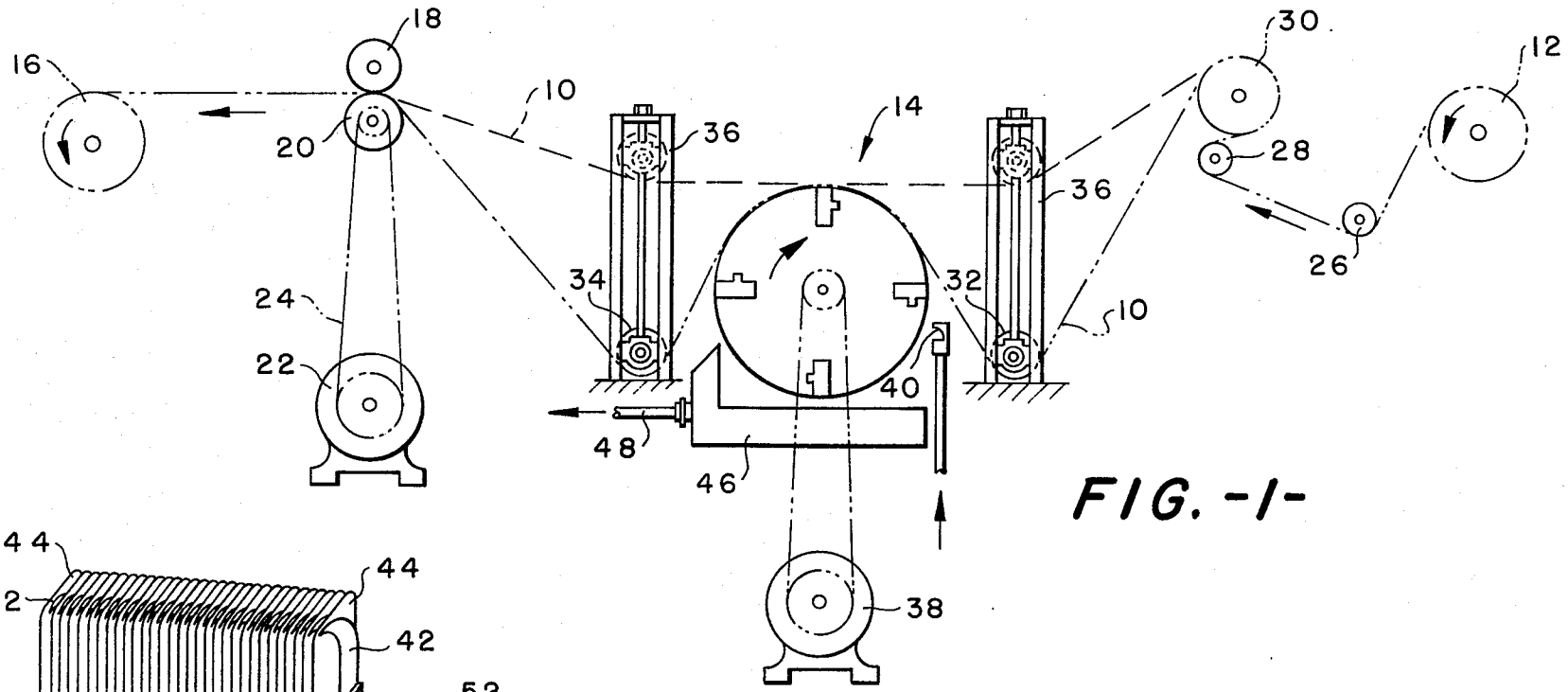
FIG. 1 is a schematic side view of the novel loop pile fabric shearing or cutting apparatus.

Looking now to the drawings and especially FIG. 1, the invention will be described. The loop pile fabric 10, such as tufted or bonded fabric, is supplied from a supply roll 12, over a rotating cutting rotor 14, to a take-up roll 16. The fabric 10 is conveyed by the action of a pair of nip rolls 18 and 20 driven by a suitable motor 22 through belt or chain 24. The fabric 10 in its path from the roll 12 to the roll 16 passes under a pair of idler rolls 26 and 28, over a guide roll 30 and under a pair of vertically reciprocably mounted idler rolls 32 and 34. The rolls 32 and 34 are suitably mounted to be vertically adjustable in the roll supports 36 to control the amount of wrap of fabric 10 around the cutting rotor 14. The cutting rotor 14 is driven by a suitable drive motor 38.

Mounted adjacent the rotor 14 is an air nozzle 40 supplied with air under pressure from a source not shown to blow lint, yarn, etc. from the rotor and especially from between the cutting blades 42 and the blade guards 44. To collect the dislodged lint, yarn, etc. a suction conduit 46 is located under the rotor 14 to pick up the lint and send it to a place of collection through conduit 48. If desired, the air nozzle can be eliminated and a rotary mounted brush substituted to physically clean out the blades.

Figure 4:
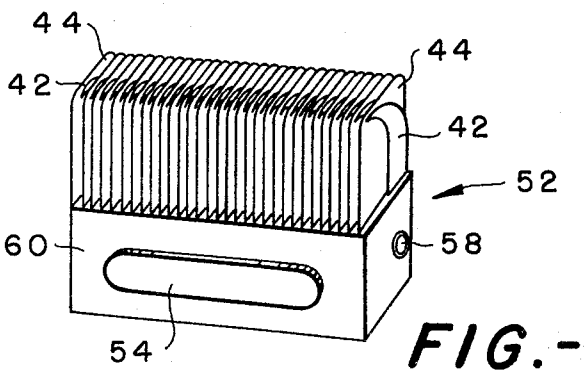
FIG. 4 is a perspective view of one of the cutting blade modules.
Figure 2:
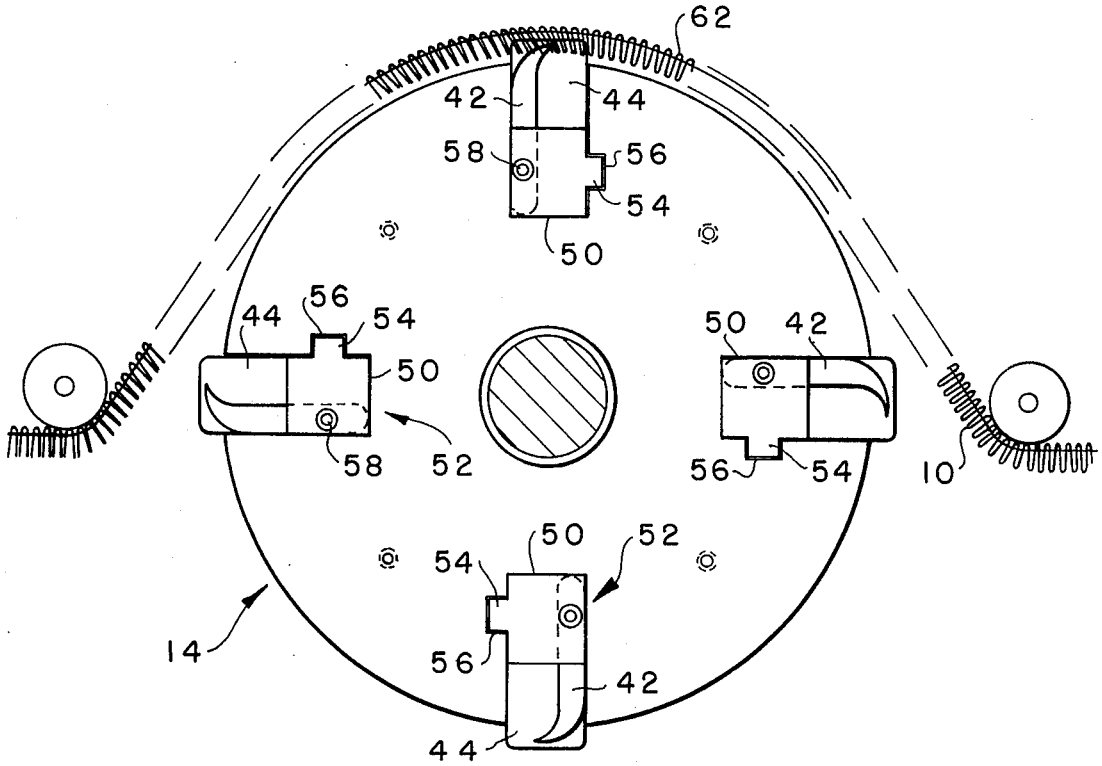
FIG. 2 is an enlarged view of the cutting rotor for the apparatus of FIG. 1.

Preferably, the rotor 14 is solid and having a plurality of grooves 50 cut therein to accommodate the cutting modules 52 therein. A plurality of modules 52 are locked in the grooves 50 across the face of the rotor 14 with the elongated projection 54 engaging the slot 56 to guide the modules in position. The modules consist of a plurality of alternated cutting blades or knives 42 and blade guards 44 held together on a pin 58 inserted through the bore thereof and molded into the base 60 of suitable plastic, pot metal, etc. with the projection 54 integral therewith. As shown in FIG. 4 approximately sixteen blades per inch are shown but the number of blades is within the realm of mechanical expediency depending on the number of loops to cut across the width of the fabric.

The guards 44 bear against the fabric 10 when the fabric engages the rotor 14 preventing the blades 42, which are recessed a pre-determined distance below the outer extremity of the guards 44, from cutting through the backing 62 of the looped pile fabric 10.

The number of blades in each module depends on a number of factors such as the number of loops in each width of fabric to be cut, the relative speeds of the rotor and the fabric, the design of the fabric, etc. The lowest loop that can be cut is basically determined by the relative difference in length between the blade and the blade guard while the number of exposures of a given loop to a cutting blade depends on the number of rows of blades in the rotor, the amount of wrap of the fabric around the rotor, the linear speed of the fabric and the speed of the rotor.

Figure 3:
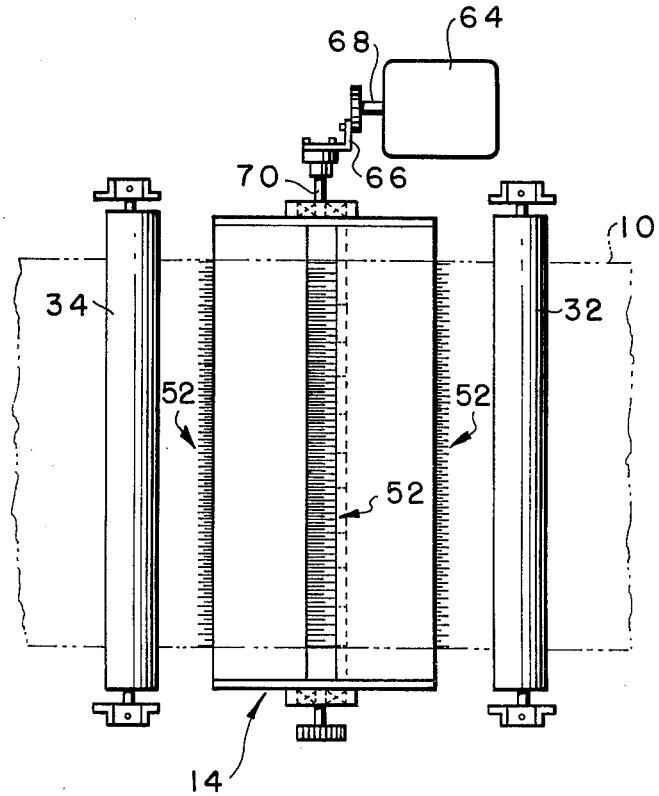
FIG. 3 is a top schematic view of the cutting rotor of the apparatus of FIG. 1.

To prevent the appearance of rows or stripes in the fabric, either the fabric 10 or the rotor 14 can be traversed. In the preferred form of the invention (FIG. 3) a motor 64 is provided to traverse the rotor 14 by the use of an eccentric 66 connected to the motor shaft 68 at one end and the rotor shaft 70 at the other end. Traverse of the rotor 14 will provide a random cut or sheared appearance on the surface of the fabric.

One of the big advantages of the invention is that the fabric to be cut or sheared can be wrapped around the rotor as it spins to provide enhanced cutting efficiency due to the fact that the blade guard prevents the backing from being cut and allows the knife blades to encounter the same loop a number of times. The process is somewhat statistical in nature, in that many passes of the knives are made through any given area of fabric, in order to minimize the probability that any loops are left uncut. Another way of expressing this is that each loop is exposed to the cutting action of a blade many times during its passage through the machine. As an example, suppose it is desired to cut the loops of a loop pile fabric possessing 25 rows of loops per inch wide of fabric (1/25 gauge). Further, assume that, due to the wrap of the fabric around the rotor, 10 linear inches of fabric are in contact with the rotor at all times, the fabric throughput speed is 3 yards per minute and the rotor speed is 2000 revolutions per minute. Under these conditions each loop, on the average, is exposed to a cutting blade approximately 474 times during its passage through the machine. This insures that the probability of a loop passing through the process without being cut is relatively small.

It is possible to obtain a patterned effect of cut and uncut pile loops in the pile fabric by taking out certain selected rows of cutting blades in each of the longitudinal rows of blades to provide a fabric possessing longitudinal stripes of uncut loops on spaced areas of the pile fabric.

Obviously, the new and novel apparatus provides a loop cutting device that not only reduces the amount of waste yarn but increases the cutting efficiency when providing a cut loop pile product. It should be noted that seams will cause no problem since the guards will prevent the blades from hitting any seams sewn in to connect pieces of fabric. Further, the guards prevent accidental insertion of the finger into the cutting blades. The new and novel apparatus provides a loop cutting device which will cut all the loops including those loops which have been laid over in handling of the fabric. The apparatus also tends to cut all the loops in the center thereof rather than on one side or the other as with prior art devices.

Although the preferred embodiment of the invention is described in detail, it is contemplated that changes may be made without departing from the scope or spirit of the invention and it is desired that the invention be limited only by the scope of the claims.

That which is claimed is:

1. Apparatus to provide a cut loop pile product comprising: a rotor, said rotor having a plurality of rows of notches therein, means to rotate said rotor, a plurality of modules mounted in each of said notches, a plurality of cutting blades and a plurality of blade guards mounted on each of said modules and projecting outwardly therefrom, said blade guards being longer than said cutting blades to prevent said cutting blades from cutting the backing of a loop pile fabric passed thereover, means to pass the loops of a loop pile fabric having a backing material into contact with the cutting blades in said module and means to take up the loop pile fabric having cut loops.

2. The apparatus of claim 1 wherein a cleaning means is located adjacent said rotor to clean lint therefrom and a suction conduit is located adjacent said rotor to pick up the lint dislodged therefrom by said cleaning means.

3. The apparatus of claim 2 wherein said cleaning means includes an air nozzle supplied with air under pressure.

4. The apparatus of claim 1 wherein a means is provided to control the amount of wrap of loop pile fabric around said rotor.

5. A module for a loop pile fabric cutter comprising: a plurality of upwardly projecting cutting blade members, a plurality of cutting blade guard members adjacent and between said cutting blade members and projecting upwardly beyond said cutting blade members and a base member molded around said blade and guard members holding them rigidly in position therein.

6. A module for a loop pile fabric cutter comprising: a plurality of upwardly projecting cutting blade members, a plurality of cutting blade guard members adjacent and between said cutting blade members and projecting upwardly beyond said cutting blade members and a base member secured to said blade and guard members holding them rigidly in position therein.

* * * * *